US009873559B2

(12) United States Patent
Nordlund et al.

(10) Patent No.: US 9,873,559 B2
(45) Date of Patent: Jan. 23, 2018

(54) DISPENSING SYSTEM AND METHOD FOR DISPENSING A PRODUCT

(75) Inventors: Cecilia Nordlund, Söråker (SE); Anna Nelvig, Göteborg (SE); Gunilla Himmelmann, Mölnlycke (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 517 days.

(21) Appl. No.: 13/375,709

(22) PCT Filed: Jun. 9, 2009

(86) PCT No.: PCT/EP2009/057092

§ 371 (c)(1),
(2), (4) Date: Dec. 1, 2011

(87) PCT Pub. No.: WO2010/142324

PCT Pub. Date: Dec. 16, 2010

(65) Prior Publication Data

US 2012/0072018 A1 Mar. 22, 2012

(51) Int. Cl.

| | |
|---|---|
| ***G07F 17/00*** | (2006.01) |
| ***B65F 1/14*** | (2006.01) |
| ***B65F 1/16*** | (2006.01) |

(52) U.S. Cl.

CPC ..... *B65F 1/1405* (2013.01); *B65F 1/1638* (2013.01)

(58) Field of Classification Search

CPC ..... B65F 1/1405; B65F 1/1638
USPC ..... 700/231, 243, 244
See application file for complete search history.

(56) References Cited

U.S. PATENT DOCUMENTS

| | | | | |
|---|---|---|---|---|
| 4,849,742 | A * | 7/1989 | Warrington | 340/545.6 |
| 4,883,749 | A * | 11/1989 | Roberts | A47K 11/04 4/304 |
| 4,996,467 | A * | 2/1991 | Day | B65F 1/1638 318/283 |
| 5,690,495 | A * | 11/1997 | Collier | 434/258 |
| 5,781,942 | A | 7/1998 | Allen et al. | |
| 5,812,059 | A * | 9/1998 | Shaw et al. | 340/573.1 |
| 5,945,910 | A * | 8/1999 | Gorra | G08B 21/245 340/573.1 |
| 5,992,430 | A * | 11/1999 | Chardack et al. | 134/115 G |
| 6,131,587 | A * | 10/2000 | Chardack et al. | 134/95.2 |
| 6,150,939 | A * | 11/2000 | Lin | B65F 1/1426 248/147 |
| 6,237,805 | B1 * | 5/2001 | Katsanevas | 221/45 |
| 6,519,130 | B1 * | 2/2003 | Breslow | B65F 1/1638 318/480 |
| 6,578,728 | B1 | 6/2003 | Weigen | |

(Continued)

FOREIGN PATENT DOCUMENTS

| | | |
|---|---|---|
| DE | 203 18 149 | 3/2004 |
| EP | 0 396 039 | 9/1994 |

(Continued)

*Primary Examiner* — Michael K Collins
(74) *Attorney, Agent, or Firm* — Drinker Biddle & Reath LLP

(57) ABSTRACT

A dispensing system including a dispenser for dispensing a product and a waste receptacle for receiving a used product. A triggering connection is present between the dispenser and the waste receptacle. The triggering connection is suitable to trigger in response to a dispensing action an encouraging action of the waste receptacle to encourage use of the waste receptacle.

24 Claims, 2 Drawing Sheets

(56) References Cited

U.S. PATENT DOCUMENTS 6,698,036 B2 * 3/2004 Armbruster et al. ..... 4/483
6,727,818 B1 * 4/2004 Wildman et al. ..... 340/573.1
6,859,005 B2 * 2/2005 Boliver ..... B65F 1/1638 220/200
6,969,964 B2 * 11/2005 Pendergrass ..... H03K 17/94 318/283
6,997,322 B2 * 2/2006 Peterson ..... 206/581
7,066,415 B2 * 6/2006 Strutz ..... 241/36
7,086,569 B2 * 8/2006 Stravitz ..... B65F 7/00 220/908
7,119,688 B2 * 10/2006 Wildman ..... 340/572.1
7,242,307 B1 * 7/2007 LeBlond et al. ..... 340/573.1
7,411,511 B2 * 8/2008 Kennish et al. ..... 340/573.1
7,423,533 B1 * 9/2008 LeBlond et al. ..... 340/572.1
7,664,656 B2 * 2/2010 Mallett et al. ..... 705/1.1
7,802,327 B1 * 9/2010 Moceri et al. ..... 4/625
7,874,247 B2 * 1/2011 Wideall ..... B30B 9/3082 100/229 A
7,886,973 B2 * 2/2011 Wagner ..... B07C 7/005 235/381
8,056,817 B2 * 11/2011 Flood ..... 235/492
8,296,875 B2 * 10/2012 Loberger ..... E03C 1/01 4/623
2002/0108507 A1 * 8/2002 May ..... B30B 9/3007 100/45
2004/0174268 A1 * 9/2004 Scott ..... B65F 1/1638 340/686.6
2005/0209585 A1 * 9/2005 Nord et al. ..... 604/540
2005/0283272 A1 * 12/2005 Roberts ..... 700/231
2007/0266637 A1 * 11/2007 McGowan ..... B65F 1/06 49/349
2008/0202357 A1 * 8/2008 Flood ..... 100/35
2008/0282911 A1 * 11/2008 Widehall ..... B30B 9/3082 100/233
2009/0202974 A1 * 8/2009 Sohn et al. ..... 434/382
2009/0223993 A1 * 9/2009 Lorenzati ..... 221/35
2010/0327000 A1 * 12/2010 Winslow et al. ..... 221/1
2011/0226795 A1 * 9/2011 Sichich ..... 221/1

FOREIGN PATENT DOCUMENTS

GB 2 224 922 5/1990
WO 98/03107 1/1998

* cited by examiner

DISPENSING SYSTEM AND METHOD FOR DISPENSING A PRODUCT

CROSS-REFERENCE TO PRIOR APPLICATION

This application is a § 371 National Stage Application of PCT International Application No. PCT/EP2009/057092 filed Jun. 9, 2009, which is incorporated herein in its entirety.

TECHNICAL FIELD

The disclosure pertains to a dispensing system for dispensing a product such as tissue paper or nonwoven towels from stacks or rolls, hankies or facial towels, soap or packaged products, and to a method for dispensing such a product.

TECHNICAL BACKGROUND

In public bathrooms using dispenser systems, in which, for example, tissue paper or nonwoven towels from stacks or rolls, hankies or facial towels, soap or packaged products are dispensed from wall-mounted dispensers, it is sometimes difficult to make sure that the users of the public bathroom throw the used paper towels in the intended waste receptacles.

In some architectural solutions or layouts of public bathrooms, the waste receptacles are somehow hidden in the furniture or appliances of the bathroom, such that they blend with the surroundings and are hard to find. Also, in frequently used bathrooms which are quite crowded it can happen that a user cannot find the waste receptacle because other users stand in front of it. And some users are simply too lazy or lost in thought to find the right place to put the used products. In particular, in these types of bathrooms, it may happen that the users throw used tissue paper towels onto the floor because they are unable to determine the actual location of the waste receptacle. These bathrooms have, after a while, a very untidy appearance due to the tissue papers on the floor.

Furthermore, with other types of dispensers, for example for dispensing cigarette packages, the users that take out cigarette packages typically immediately unwrap the foil around the packages and need to dispose of it. Accordingly, also in the close surroundings of such cigarette dispensers, the environment can become untidy.

In order to attract a user to throw away waste and rubbish properly, GB 2 224 922 A suggests a stand-alone waste receptacle comprising a receptacle and a cover having a hinged flap. The flap, when pushed inwards, contacts a microswitch inside the cover which actuates a battery-operated microprocessor unit programmed to emit sound such as singing, talking, whistling or eating noises via a loudspeaker.

However, the solution suggested in this British prior art document does not overcome the problem of actually locating the waste receptacle in order to guide a user into the right direction.

SUMMARY

Starting from this background, it is desired to provide a dispensing system and a method for dispensing a product which improves the environmental aspects of present dispensing systems and methods.

Accordingly, a dispensing system is provided which includes a dispenser for dispensing a product, and a waste receptacle for receiving a used product. A triggering connection between the dispenser and the waste receptacle is provided which is suitable to trigger in response to a dispensing action of the dispenser an encouraging action of the waste receptacle to encourage use of the waste receptacle.

By means of the triggering connection between the dispenser which dispenses a product and the waste receptacle and by triggering an encouraging action, a user which uses the dispensing system is clearly directed towards using the waste receptacle after having used a product from the dispenser.

A typical scenario would be that the tissue paper towel dispenser in a public bathroom triggers via the triggering connection, after a tissue paper is dispensed from the dispenser and taken by a user, an encouraging action of the waste receptacle that is connected to the dispenser. The waste receptacle can be a waste receptacle which is situated substantially below the dispenser, but could also be any other architecturally suitable solution, such as a disposal opening in a washstand, a disposal opening in a wall or in the floor, or any other location where the used papers are to be deposited according to the specifications of the architects.

The encouraging action, which is triggered by the dispenser via the triggering connection, may be emitting a sound and/or emitting a light and/or carrying out a mechanical action, such as lifting a lid off the receptacle, shaking the waste receptacle or the lid, or any combinations of the afore-mentioned actions. In particular, a sound and/or light signal indicating the actual location of the waste receptacle is contemplated, in particular in the form of blinking lights and a beeping or whistling sound. The colour and brightness of the respective lights and the frequencies and volume of the respective sound may be provided such that they can be sensed by the average user, in particular also by users with hearing or seeing handicaps. The provision of light and/or sound is particularly advantageous in solutions where the waste receptacle is hidden by architectural means.

As an encouraging action, also the lid of the waste receptacle could be simply lifted, in order to show to the user the actual location of the waste receptacle. The waste receptacle could also be moving or shaking as a whole, which has the additional advantage that waste which is already received in the receptacle might be slightly compacted.

The dispensers contemplated in this system include tissue paper towel dispensers, in particular for dispensing tissue towels or toilet paper, soap dispensers, packaged product dispensers, such as cigarette package dispensers, or the like.

When using a soap dispenser as the triggering means for triggering the encouraging action of the waste receptacle, the logic behind this is that, after a user has used soap, he will inevitably wash his hands and then need a paper towel for drying the hands. The soap dispenser could also trigger an encouraging action emitted by the towel dispenser to guide the user towards the tissue paper towel dispenser. In this particular case, the user is guided towards the tissue paper dispenser quickly and, after having taken from the tissue paper dispenser a tissue paper towel, the waste receptacle carries out the encouraging action to encourage the user to place the used towel into the waste receptacle.

In order to provide a convenient triggering connection between the dispenser, or the dispensers, and the respective waste receptacle, this triggering connection can be provided mechanically and/or electronically, wherein the latter case a wired or a wireless triggering connection is contemplated. In particular embodiments, the triggering connection is made on the basis of a bus system. As conventional building bus systems, LCN (Local Control Network), KNX/EIB (European Installation Bus) or any other suitable bus system can be used.

It is also contemplated that a single dispenser triggers encouraging actions of more than one waste receptacle or, vice versa, that more than one dispenser triggers an encouraging action of a single waste receptacle. This very much depends on the actual layout of the respective bathroom, such that it might become necessary that a single and centrally arranged waste receptacle, which might be designed to blend into the design of the bathroom, carries out an encouraging action when triggered by any of the dispensers available in the bathroom.

On the other hand, if there is more than one waste receptacle in the bathroom, it is contemplated that specific dispensers and specific waste receptacles are grouped together in order to direct the users always towards the nearest waste receptacle or even to the nearest waste receptacles such that they can choose between the nearest receptacles.

It is also contemplated that the waste receptacle has a proximity sensor, such that it can sense whether a user is actually just in front of the waste receptacle. A control unit may then direct a second user towards a different waste receptacle in order to avoid crowds in front of a waste receptacle.

It is also contemplated to include into the waste receptacle means for compacting the waste received in the waste receptacle. The compacting action could be triggered by means of the encouraging action.

It is contemplated that the dispensing system includes a control unit for controlling the triggering connection, controlling the triggering of the encouraging action, controlling the sequence of actions in a multi-dispenser and/or multi-waste-receptacle environment, controlling a time delay between a dispensing action and an encouraging action, controlling a duration for holding open a lid of a waste receptacle, controlling a duration for carrying out the encouraging action and/or any other control action required in connection with the dispensing system. The control unit can be provided, in the case of an electronic triggering connection in the form of a microprocessor unit, and in the case of a mechanical triggering unit in the form of a mechanical guiding means.

The control unit might also provide a time delay between the actual dispensing action and the encouraging action in order to take into account the fact that average users need some time to dry their hands before the used paper towel is to be thrown away. This time delay could also be triggered by a proximity sensor or a receiving sensor in the waste receptacle which senses whether a towel has already been placed into the receptacle.

If a user places a towel into the receptacle within a certain time period after the dispensing action, the encouraging action may be omitted. In other words, if a user does not need to be guided towards the waste receptacle and if he is not lost as to the actual location of the waste receptacle, the encouraging action of the waste receptacle could also be omitted in order to reduce the noise and information level in the bathroom.

The objective set out above is also solved by a method for dispensing a product, including the steps of dispensing a product from a dispenser, wherein the dispenser triggers an encouraging action of a waste receptacle via a triggering connection between the dispenser and the waste receptacle, and carrying out the encouraging action by the waste receptacle in response to the triggering action of the dispenser.

It is to be understood that the present system and method may also be used in connection with other dispensing systems which require a waste removal action after the dispensing process has taken place. This is in particular the case with dispensers which dispense products having some sort of packaging which is typically removed by a user before use, and the products are used immediately.

This can be the case, for example, for cigarette package dispensers where the user typically immediately opens the package and needs a waste receptacle to throw away the foil situated around the package as well as the aluminum foil inside the package.

This might also be the case with dispensers for chewing gum, for kids toys which are typically packed, dispensers for dispensing packages with shower heads, soap or toilet paper in public bathrooms, for example on a highway, or for other machines dispensing packaged products.

BRIEF DESCRIPTION OF THE FIGURES

In the following, the current disclosure will be explained in detail by the embodiments shown in the following Figures, in which.

DETAILED DESCRIPTION OF PREFERRED EMBODIMENTS

Figure 1:
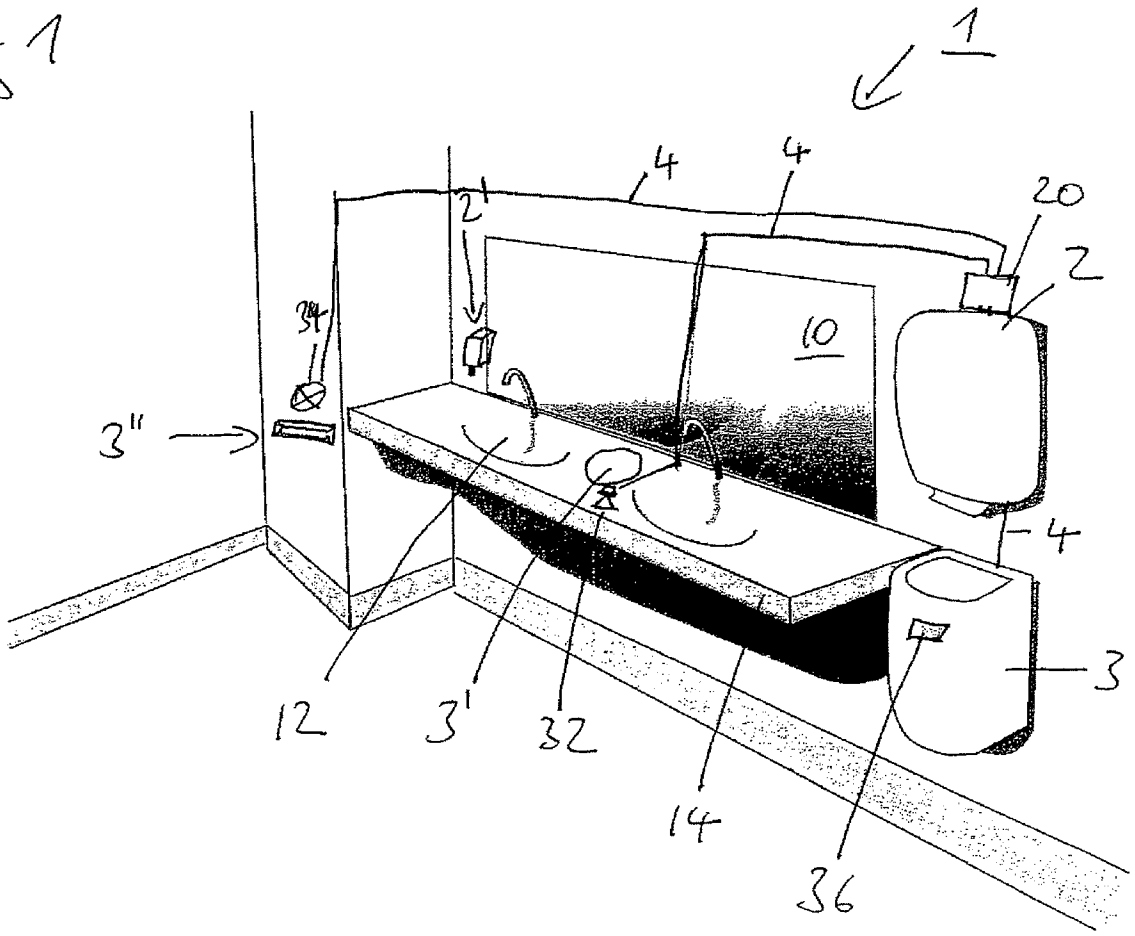
FIG. 1 is a schematic perspective view of a public bathroom.

In the following, similar items and details will be denoted by the same reference numerals and repeated description thereof will be omitted in order to reduce redundancies.

The embodiment shown in FIGS. 1 to 5 is an exemplary embodiment of a typical bathroom having a mirror 10, washing basins 12 and a washstand 14. A dispensing system 1 including a towel dispenser 2 and a waste receptacle 3 is provided.

The typical and intended procedure in such a public bathroom is that the users approach the washing basin 12, wash their hands, take a towel from the towel dispenser 2, dry their hands and throw away the used paper towel into the waste receptacle 3.

However, the schematic bathroom shown in FIG. 1 has a preferred layout which is very seldom found in real-life layouts. In particular, quite often the tissue towel dispensers 2 are mounted remote from the waste receptacles 3. Accordingly, the typical scenario is that, after the users have washed their hands, they start searching for the towel dispenser 2 and, after eventually having found the towel dispenser 2, dry their hands and start looking for a place where they can throw away the used paper towels.

Sometimes, the waste receptacles 3 are hidden somewhere in the bathroom or are integrated by the architect into not so intuitively identifiable locations, such as in the form of a hole 3' in the washstand 14 or as a slit 3" somewhere in a wall. It is then very difficult for the users to find the right location to dispose of the used paper towels. Accordingly, frequently the used paper towels end up somewhere on the floor of the bathroom instead of placing it into its intended destination.

According to the present embodiment, the dispenser 2 and the waste receptacle 3 are connected to one another by means of a triggering connection 4 such that the dispenser 2 triggers an encouraging action of the waste receptacle to encourage the users to locate and use the correct waste receptacle.

The actual triggering connection 4 between the dispenser 2 and the waste receptacles 3, 3', 3" may be provided by means of electric wiring 4. However, it is also contemplated to provide the triggering connection as a wireless triggering connection between the dispenser 2 and the respective waste receptacles 3, 3', 3" or to provide a mechanical triggering connection.

Figure 3:
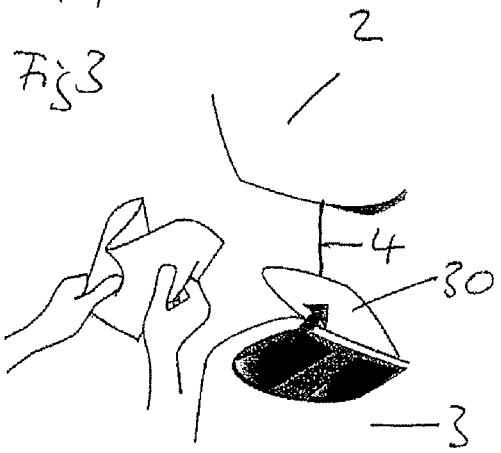
FIG. 3 is a schematic perspective view of the coupling between the tissue paper dispenser and a waste receptacle.

As soon as a towel is dispensed from the dispenser 2, the triggering connection 4 between the dispenser 2 and the respective waste receptacles 3, 3', 3" triggers an encouraging action. In case of the waste receptacle 3, which is shown as a classical waste paper bin, this encouraging action could be lifting the lid 30 in the form as shown in FIG. 3. This lifting of the lid clearly encourages the user to throw the used tissue paper into the waste receptacle 3 and also guides the user towards this waste receptacle, as the user can sense the opening action, i.e. a movement action somewhere in the room, easily.

However, as an alternative and as is schematically shown at the waste receptacle 3', a loudspeaker 32 or any other sound-emitting device, such as a piezo-device, can be situated at the receiving opening of the waste receptacle to emit a sound to encourage the user to throw the used tissue towel into the respective waste receptacle 3'.

In another alternative, as is schematically shown at the waste receptacle 3", a lamp 34 is provided which emits an optical signal in the form of a constant or a blinking light to guide the user towards the correct opening to throw away the used towel.

In an alternative, a soap dispenser 2' may be present in the vicinity of the washing basin 12 and the dispensing action of the soap dispenser 2' actually triggers the encouraging action of the respective waste receptacles 3, 3', 3". Naturally, an automatic water tap with the respective sensing means could also be used as a first triggering means.

It is also contemplated to provide a control unit 20 for controlling the triggering connection, controlling the triggering of the encouraging action, controlling the sequence of actions in a multi-dispenser and/or multi-waste receptacle environment, controlling a time delay between a dispensing action and an encouraging action, controlling a duration for holding open a lid of a waste receptacle, controlling a duration for carrying out the encouraging action and/or any other control action required in connection with the dispensing system. In other words, the control unit 20 controls the triggers, the actions and their respective timing of the dispensing system.

The control unit 20 is, in the embodiment shown, provided in the form of a microprocessor which receives several inputs, e.g. signals of a proximity or pressure sensor of the respective dispenser 2, and/or signals of a proximity sensor of the waste receptacle 3, 3', 3", and sends several outputs, e.g. a triggering signal to the respective waste receptacle 3, 3', 3" to trigger an encouraging action, and/or a triggering signal to another dispenser to dispense a different product. The control unit 20 in the form of the microprocessor also coordinates the communication between the different pieces of hardware. This is even more so the case when the dispensers 2 and the waste receptacles 3, 3', 3" are connected via a bus system. In this case, the control unit 20 can also be situated in a remote location.

The time delay which can be provided by the control unit 20 might effect that the encouraging action is carried out only after a predetermined time interval such that, after dispensing the soap from the soap dispenser 2', the encouraging action of one of the waste receptacles 3, 3', 3" is carried out only after a certain time.

It is also contemplated to provide a triggering connection 4 between the soap dispenser 2', the tissue paper dispenser 2 and the respective waste receptacles such as to guide the user from the soap dispenser 2', to the towel dispenser 2 and then to the waste receptacle 3 in the proper order.

Figure 2:
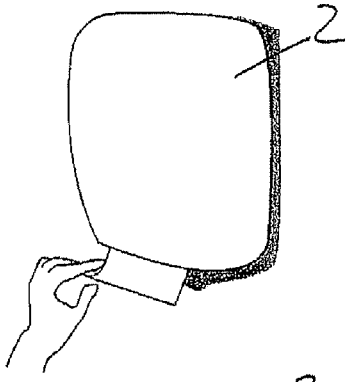
FIG. 2 is a schematic perspective view of a tissue towel dispenser.
Figure 4:
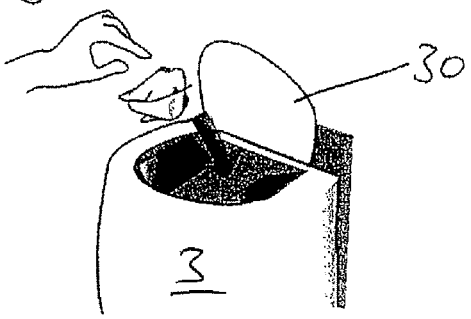
FIG. 4 is a schematic perspective view of the waste receptacle.

The actual method is shown in FIGS. 2 to 4. In particular, FIG. 2 shows the towel dispenser 2 while dispensing a towel which is consequently gripped by a user. As soon as the user has withdrawn a paper towel from the dispenser 2, the dispenser 2 triggers via the triggering connection 4 an encouraging action of the waste receptacle 3, as is shown in FIG. 3. In the case of the waste receptacle of FIG. 3, the lid 30 is lifted as the encouraging action. Of course, additionally a light signal and/or an acoustical signal can be emitted from the waste receptacle 3 in order to further attract the attention of the user.

The user is then encouraged to throw away the used paper towel into the waste receptacle 3, as shown in FIG. 4. After the waste receptacle 3 senses that the towel is thrown into the waste receptacle, the lid 30 is closed again, in particular after a predetermined time delay.

Furthermore, after a predetermined time delay, the other possible encouraging actions, i.e. sound and/or light signals, stop.

In addition, if a group of dispensers trigger a waste receptacle, the waste receptacle is kept carrying out the encouraging action until a predetermined time delay has elapsed after the actual triggering action, such as to keep encouraging the user to actually use the waste receptacle while still drying the hands.

Figure 5:
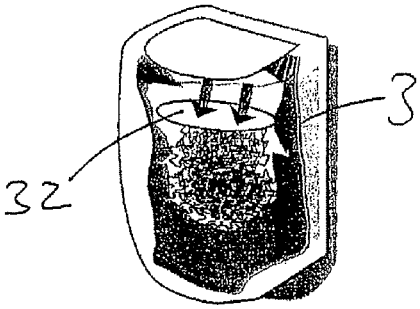
FIG. 5 is another schematic perspective view of the waste receptacle having a mechanical compression means.

In particular embodiments, the waste, in particular the paper towels, are compacted in the waste receptacle 3, in the form as shown in FIG. 5. In particular, in the waste receptacle 3, a mechanical compacting means 32 may be present, which exerts a pressure onto the used tissue paper towels which are placed into the waste receptacle. There are several different possibilities of compacting the waste in a waste receptacle known in the prior art.

It is contemplated to provide the triggering connection 4 between the respective dispensers 2, 2' and the waste receptacle 3, 3', 3" in the form of a bus system, in particular in the form of the regular bus system that is present in up-to-date facility management systems. In particular, a LCN (Local Control Network), a KNX/EIB (European Installation Bus) or any other suitable bus system may be used in this respect. Using a bus system may have the additional advantage that the dispensers and the waste receptacles can be remotely controlled.

A proximity sensor 36 may be present at the waste receptacle 3 in order to sense whether a user is close to the respective receptacle 3. The proximity sensor 36 can be used either to re-direct a triggering action for an encouraging action to another waste receptacle in order to avoid that more than one user is guided to use the same waste receptacle at the same time, or it could be used to trigger an encouraging action of the waste receptacle which is closest to the respective user.

The waste receptacle could also indicate that it has reached its maximum filling capacity, as sensed by a suitable sensor, such that the triggering of the encouraging action can be re-directed to a different waste receptacle, should this be present and still not full.

Naturally, the lid of a waste receptacle according to the present disclosure can still be lifted by a user manually in the conventional way.

The invention claimed is:

1. A dispensing system comprising:

a dispenser including a housing with a mechanism for performing a dispensing action by a product and a sensor for sensing when the product is dispensed;

a waste receptacle housing including an opening for receiving the product, wherein the waste receptacle housing is separate from and outside of the dispenser housing, and a triggering connection between the dispenser sensor and the waste receptacle housing, the triggering connection being configured to trigger, in response to each occurrence of the dispensing action, an encouraging action of the waste receptacle housing to encourage a user of the dispensing system to use the waste receptacle, the encouraging action being performed at the waste receptacle housing, the encouraging action being a light signal emitted from the waste receptacle housing.

2. The dispensing system according to claim 1, wherein the encouraging action further includes a sound emitted by the waste receptacle housing, a mechanical action, or shaking of the waste receptacle housing or any combinations thereof.

3. The dispensing system according to claim 1, wherein the dispenser is a tissue paper dispenser or a packaged product dispenser.

4. The dispensing system according to claim 1, wherein the triggering connection between the dispenser sensor and the waste receptacle housing is a mechanical triggering connection, an electronic triggering connection, or a bus system.

5. The dispensing system according to claim 1, wherein more than one dispenser sensor triggers the action of a single waste receptacle housing.

6. The dispensing system according to claim 1, wherein more than one waste receptacle housing is triggered by a single dispenser sensor.

7. The dispensing system according to claim 1, wherein the waste receptacle housing further comprises a waste compacting device for automatically compacting the contents of the waste receptacle housing.

8. The dispensing system according to claim 1, wherein another triggering connection is provided between a first dispenser and a second dispenser to trigger an encouraging action of the second dispenser.

9. The dispensing system according to claim 1, wherein the dispensing system comprises a control unit for controlling the triggering connection, controlling the triggering of the encouraging action, controlling the sequence of actions in a multi-dispenser or multi-waste receptacle environment, controlling a time delay between a dispensing action and an encouraging action, controlling a duration for holding open a lid of a waste receptacle, controlling a duration for carrying out the encouraging action, or any other control action required in connection with the dispensing system.

10. The dispensing system according to claim 9, wherein the control unit is configured to provide a delay between a dispensing action and an encouraging action.

11. The dispensing system according to claim 1, wherein the encouraging action further includes at least one of:

(a) automatically lifting a lid of the waste receptacle housing, and (b) providing a sound from a sound emitting device situated at the receiving opening in the waste receptacle housing.

12. A method for dispensing a product by a dispenser, comprising the steps of:

dispensing a product from a dispenser housing of the dispenser;

sensing when the product is dispensed by a sensor situated in the dispenser housing;

completing a triggering connection between the dispenser sensor and a waste receptacle having a waste receptacle housing that is separate from and outside of the dispenser housing, the triggering connection being configured to trigger, in response to each occurrence of said dispensing, an encouraging action of the waste receptacle housing to encourage a user of the dispenser to use the waste receptacle; and carrying out the encouraging action in response to the triggering connection at the waste receptacle housing, the encouraging action being a light signal emitted from the waste receptacle housing.

13. The method according to claim 12, wherein the encouraging action further includes emitting a sound, carrying out a mechanical action, or shaking the waste receptacle housing or any combinations thereof.

14. The method according to claim 12, wherein the encouraging action is triggered mechanically, electronically, or by the provision of a bus system.

15. The method according to claim 12, wherein more than one dispenser sensor triggers the action of a single waste receptacle housing.

16. The method according to claim 12, wherein more than one waste receptacle housing is triggered by a single dispenser sensor.

17. The method according to claim 12, wherein the waste receptacle housing automatically compacts the contents of the waste receptacle housing.

18. The method according to claim 12, wherein an encouraging action of a second dispenser is triggered by a first dispenser.

19. The method according to claim 12, wherein a time delay is provided between a dispensing action and an encouraging action.

20. The method according to claim 19, wherein the time delay is provided only if a used product is not put into the waste receptacle within a predetermined time.

21. The method according to claim 12, wherein the encouraging action further includes at least one of:

(a) automatically lifting a lid of the waste receptacle housing, and (b) providing a sound from a sound emitting device situated at the receiving opening in the waste receptacle housing.

22. The method according to claim 12, further comprising compacting the contents of the waste receptacle housing with a waste compacting device included in the waste receptacle housing.

23. A dispensing system, comprising:

a dispenser including a housing with a mechanism for dispensing a product and a sensor for sensing when the product is dispensed;

a waste receptacle housing including an opening for receiving the product and a lid, the waste receptacle housing being separate from and outside of the dispenser housing, and a triggering connection between the dispenser sensor and the waste receptacle housing, wherein the triggering connection is suitable to trigger, in response to each occurrence of a dispensing action, an encouraging action of the waste receptacle housing to encourage use of the waste receptacle, and wherein the encouraging action at least includes automatically opening the lid by rotating the lid around a hinge to an open position in which the lid is visible to a user by at least a portion of the lid being outside all walls of the waste receptacle.

24. A method for dispensing a product, comprising:

dispensing a product from a dispenser housing;

sensing when the product is dispensed by a sensor situated in the dispenser housing; and completing a triggering connection between the dispenser sensor and a waste receptacle housing that is separate from and outside of the dispenser housing, the triggering connection being suitable to trigger, in response to each occurrence of a dispensing action, an encouraging action of the waste receptacle housing, wherein the waste receptacle housing carries out the encouraging action in response to the triggering connection, and wherein the encouraging action at least includes automatically opening a lid of the waste receptacle housing by rotating the lid around a hinge to an open position in which the lid is visible to a user by at least a portion of the lid being outside all walls of the waste receptacle housing.

* * * * *